United States Patent [19]

Caswell et al.

[11] 4,223,807

[45] Sep. 23, 1980

[54] MULTIPLE PRODUCT GASOLINE DISPENSER

[75] Inventors: Richard L. Caswell; John A. Todd, both of Salisbury, Md.

[73] Assignee: Dresser Industries, Inc., Dallas, Tex.

[21] Appl. No.: 10,294

[22] Filed: Feb. 8, 1979

[51] Int. Cl.[3] ..... B67D 5/08

[52] U.S. Cl. ..... 222/28; 222/144.5

[58] Field of Search ..... 222/25, 28, 32, 35, 222/144.5

[56] References Cited

U.S. PATENT DOCUMENTS

| | | | |
|---|---|---|---|
| 2,792,148 | 5/1957 | Goldenberk | 222/28 X |
| 3,895,738 | 7/1975 | Buchanan et al. | 222/28 X |

*Primary Examiner*—Charles A. Marmor
*Attorney, Agent, or Firm*—Daniel Rubin

[57] ABSTRACT

Customer dispensing of either unleaded or one of two or more grades of leaded gasoline products is selected by rotatable selector knobs located on the dispenser housing. Individual meters are operative by the leaded and unleaded dispensing systems which are hydraulically isolated from each other. The separate selector knobs are associated with each of the leaded and unleaded dispensing systems and are effective when actuated to render the other system inoperative by an imposed mechanical interlock. Bothe meters operate a common computers for calculating the transaction data of each dispensing sale.

7 Claims, 8 Drawing Figures

MULTIPLE PRODUCT GASOLINE DISPENSER

TECHNICAL FIELD

The field of art to which the invention pertains includes the art of gasoline dispensing equipment.

BACKGROUND OF THE INVENTION

It has long been typical on gasoline dispensing sites to essentially utilize separate systems for dispensing different grades of leaded gasoline such as "premium," and "regular." On-site dispensers for like grades are hydraulically coupled with each individual dispenser frequently having its entirely own meter, computer, etc. separate from the others. With the advent of blending-type dispenser pumps, an increasing number of intermediate fuel grades became available from a single pump dispenser by blending various mixtures of regular and premium prior to entering the dispenser nozzle. Blending pumps as, for example, disclosed in U.S. Pat. Nos. 3,838,797 and 3,424,348 established a trend away from using separate dispenser units by making a variety of fuel grades available from a common dispenser operating a single computer. However, with the introduction of unleaded fuels for model cars beginning with 1975, the trend was essentially reversed by the requirement to maintain complete and total isolation between the unleaded and leaded dispensing systems. Needless to say, these completely separate systems have proven costly for the station proprietor but despite recognition of the problem, a ready solution has not heretofore been known.

SUMMARY OF THE INVENTION

The invention relates to gasoline dispensers and more specifically to a dispenser for multiple products that include both unleaded and two or more leaded fuel grades from a single dispenser unit utilizing a common computer for calculating the dispensing data of each. This is achieved in accordance herewith by a dispenser unit having separate inlet connections for each of the unleaded and leaded fuels. Blending apparatus may optionally be included for mixing regular and premium grades of the latter to effect two or more intermediate blended grades thereof. The leaded and unleaded systems are maintained hydraulically isolated throughout from their inlet connections to their dispenser nozzles. Two separate selector knobs, one for unleaded fuel and one for the various grades of leaded fuel, are situated on the pump housing for customer selection. Each of the selector knobs when actuated renders the other system inoperable via a mechanical interlock effected thereby. The systems are separately metered and all meters are coupled to a common computer for calculating dispensing data of each transaction such that one computer serves all selections available from the one dispenser unit.

It is therefore an object of the invention to provide a novel gasoline dispenser having a common computer for multiple products including both unleaded and two or more grades of leaded fuels.

It is a further object of the invention to provide a multiple product gasoline dispenser as in the previous object with selector knobs and associated operating handles mechanically interconnected with each other enabling only one selected fuel composition or grade to be dispensed at a time.

It is a still further object of the invention to effect the foregoing objects in an economical manner enabling a significant cost saving in gasoline dispensing equipment.

BRIEF DESCRIPTION OF THE DRAWINGS

Referring now to FIGS. 1–4 of the drawings, there is illustrated a gasoline dispenser 10 in accordance herewith formed of an outer housing 12 displaying totalizer sales data from a previous transaction including total cost of sale 14 and total volume of sale 16. Also shown are unit price per gallon displays 18, 20 and 22 for regular, unleaded and premium grades of fuel, respectively. Above each of the unit price windows is a window 24 reflecting a "sale" indication identifying which particular fuel is or was being dispensed. On the right side of housing 10, as illustrated, is a selector knob 26 rotatably positioned at the location shown for dispensing unleaded fuel and a rotatable handle 27 operable in conjunction therewith as will be explained. Also shown thereat is a hose 28 through which unleaded fuel can be dispensed via a nozzle 30 supported when unused in a holster 32.

Figure 7:
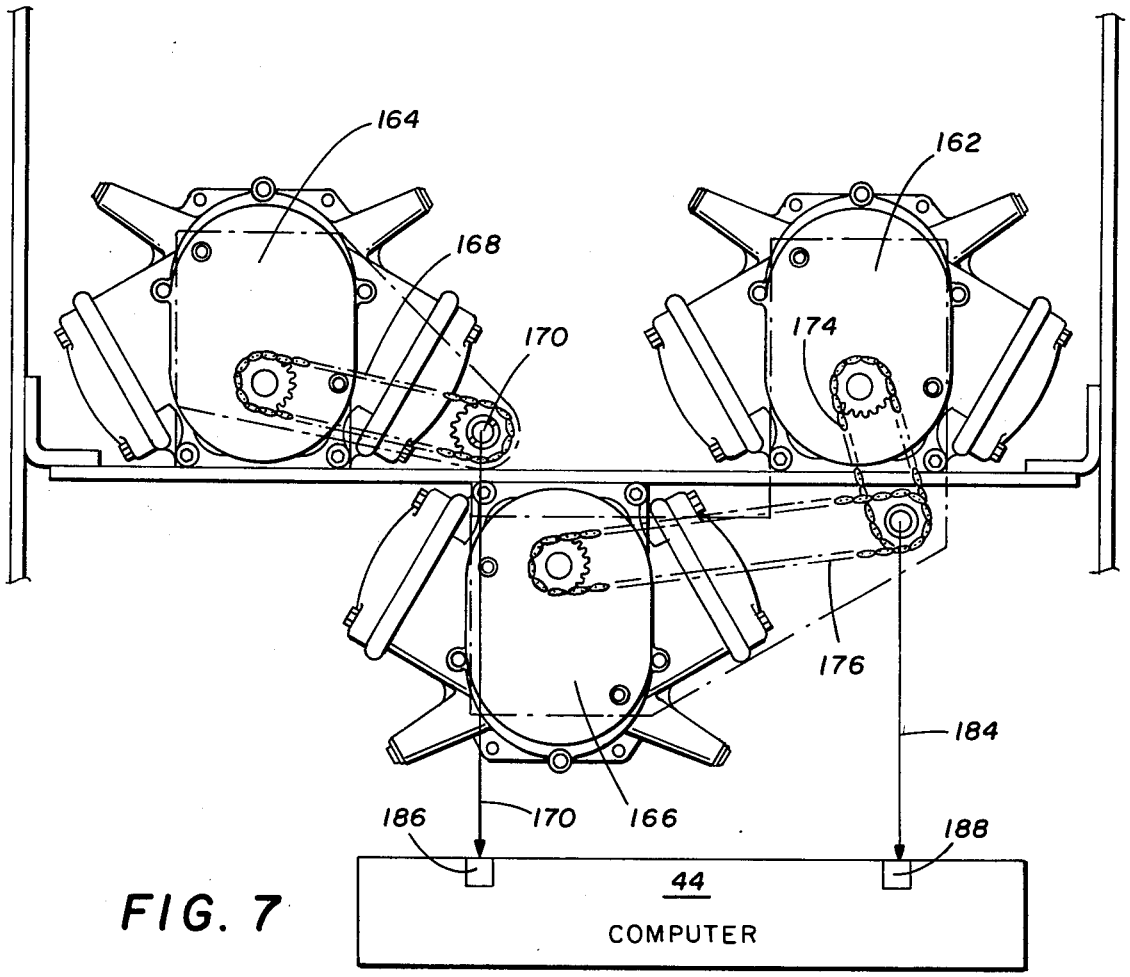
FIG. 7 is a plan view of the individual meters and computer partially in block diagram form for the different fuel grades.
Figure 8:
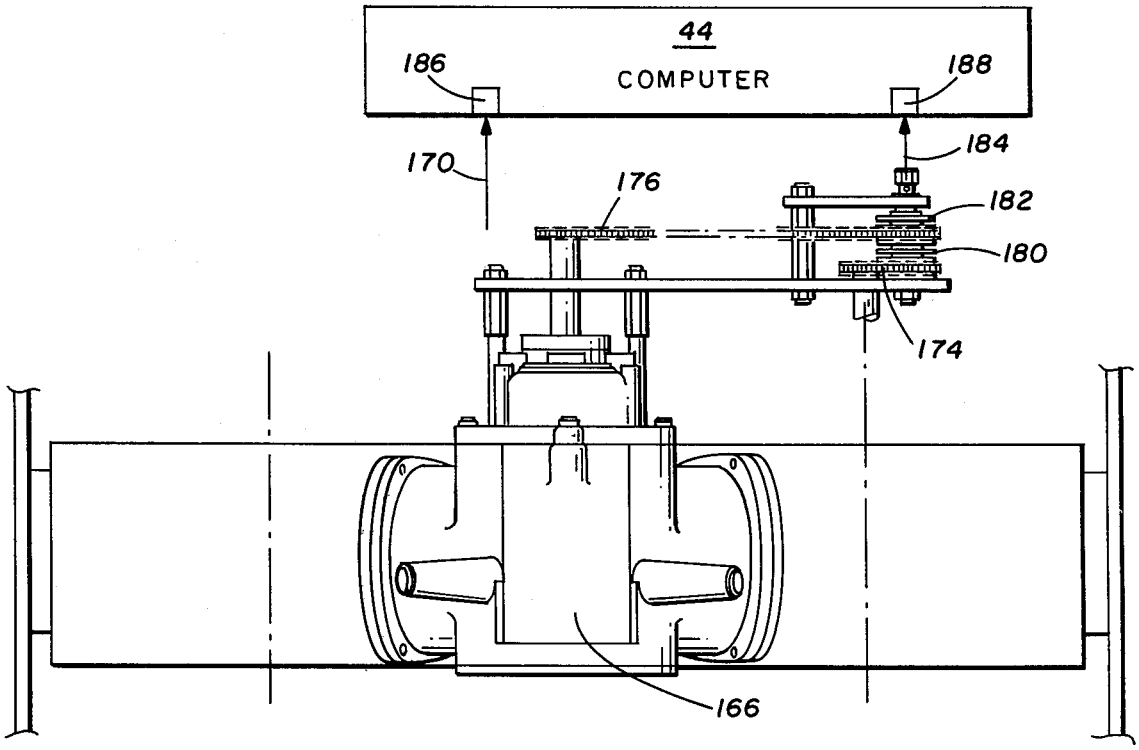
FIG. 8 is a forefront elevation view of FIG. 7.

Supported on the left or opposite side of housing 12 is a selector knob 34 rotatably positionable at the "regular," "premium," or "stop" positions or such other positions for intermediate grades of leaded fuel when blending is provided. Handle 36 is operable in conjunction with knob 34 as will be explained whereby the selected leaded fuel can be dispensed through a hose 38 and nozzle 40 which when unused is supported on holster 42. For the embodiment being described, hose 38 comprises a commercially available hose-within-a-hose type construction whereby regular grade fuel is dispensed through the inner hose and premium grade is dispensed through the outer hose both communicating with common nozzle 40. With this construction leaded fuels of high and low octane rating are kept separated in hose 38 up to the common nozzle 40 at which point if both are being dispensed simultaneously they can be caused to mix for purposes of blending. Whichever system is operative, a common computer 44 (FIGS. 7 and 8) operates totalizer displays 14 and 16.

Selectively placing one of selector knobs 26 or 34 in a dispensing position and then actuating its associated operating handle 27 or 36 serves to interlock against similar positioning of the opposite knob as will now be described with more specific reference to FIGS. 3–6. Considering first the dispensing of leaded fuel, knob 34 is connected via a shaft 45 with a selector disc 46 that is caused to rotate therewith. Also rotatable therewith is a sprocket 48 supporting an endless chain 50 for advancing sprocket 51 and cross shaft 53. Disc 46 cooperates with an interlock arm 56 and includes arcuately spaced detent recesses 52 for receiving the offset detent end 54 of arm 56. The interlock arm is pivotally supported about a pin 58 and is spring biased in a counterclockwise direction in the orientation of FIG. 5 by tension spring 60 mounted at its other end on a pin 61. At the opposite end of arm 56 is a lateral detent or foot 64 adapted to engage in a detent recess 68 of a disc 66. The disc is supported on shaft 70 which is rotatable by operating handle 36 and when free of detent 64 permits operating handle 36 to then rotate the disc from the position of FIG. 5 to the position of FIG. 6. Rotation of knob 34 also operates to set the "sale" indication in one of the windows 24 appearing above the appropriate grade window 18 or 22.

Rotation of operating handle 36 turns shaft 70 to which is attached a lever arm 76 at the distal end of which is connected one end of a link lever 78. The opposite end 80 of lever 78 is offset and connected to a lever arm 82 in turn secured to a shaft 84 being supported by a bearing 87 at one end and a lever hub 144 on the other end. Also secured on shaft 84 is a lever arm 88, the distal end of which supports the offset end 90 of an actuating rod 92. The other end of the rod is received in a slideable connection with a clevis 94 supported for rotation via lever arms 96 and 158. The latter arms are secured to rotatable shaft 102 and are directionally biased by spring 98. A shoulder collar 100 on rod 92 is operative to overcome the force of spring 98 as will be explained.

Figure 5:
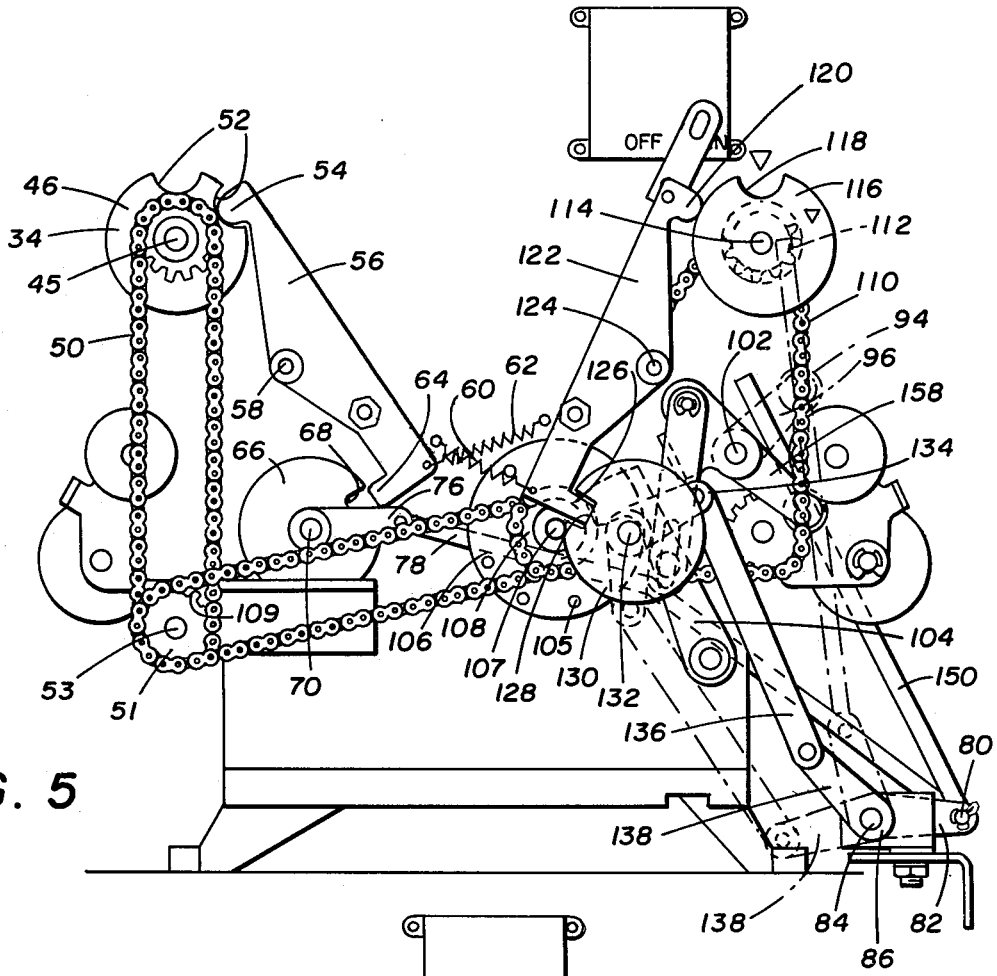
FIGS. 5 and 6 are elevation views taken substantially along the lines 5—5 and 6—6 of FIG. 4 for different operating positions of the linkage.
Figure 6:
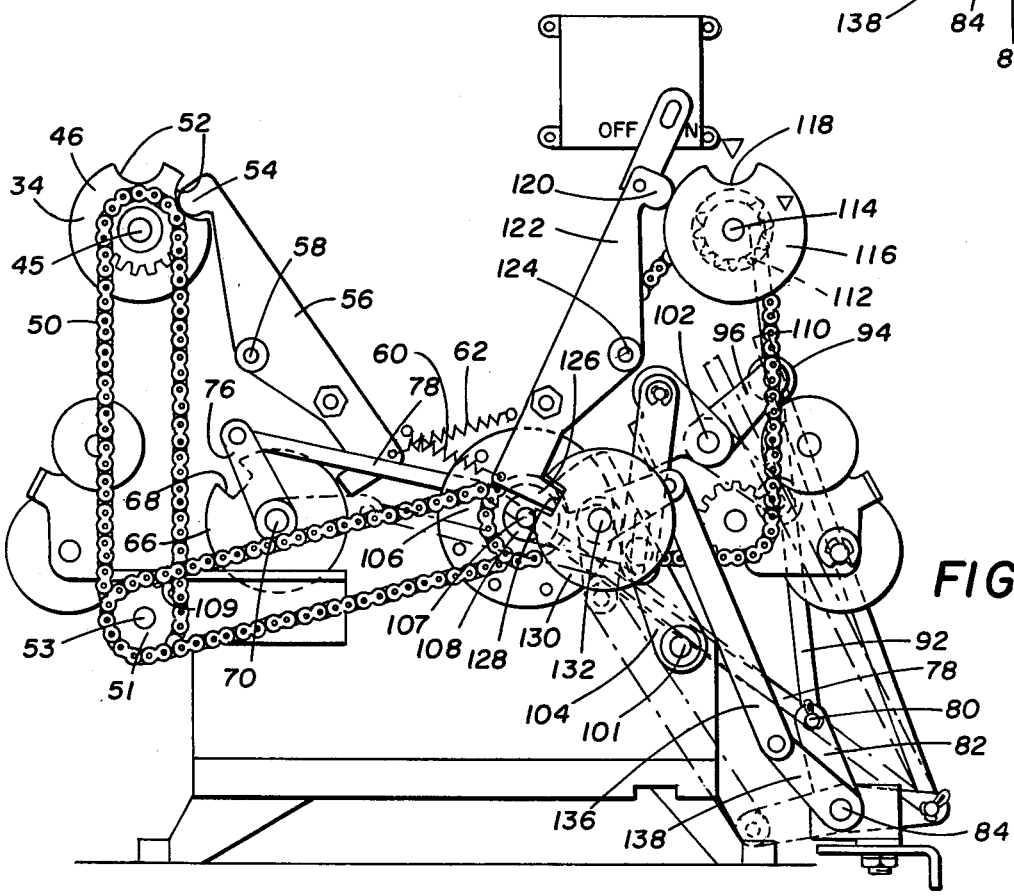

Counterclockwise rotation of lever arm 82 as seen in FIG. 5 from displacement of lever 78 effects a corresponding rotational displacement of shaft 84 which, via actuating rod 92, upwardly displaces rod shoulder collar 100 toward clevis 94. The clevis, in turn, being mounted in the outboard ends of lever arms 96 and 158 will, when engaged by shoulder 100, be forced counterclockwise to the position shown dashed in FIG. 5, causing lever arms 96 and 158 and shaft 102 to be displaced counterclockwise. Rotation of the latter shaft effects concomitant rotation of locking pawl 104 which engages between bosses 105 on the blend selector indexing wheel 106 to effectively prevent movement thereof. Likewise effected by rotation of shaft 102 is computer readying to zero position which actuates appropriate mechanism in a well known manner to allow energizing the pump controls.

Imposing the interlock for leaded fuels in accordance herewith is effected by first rotating grade selector knob 34 to dispenser position for regular or premium. This serves to rotate cross shaft 53 supporting sprocket 109. Chain 113 on sprocket 109 thereby drives sprocket 111 on shaft 107 to in turn drive sprocket 108, chain 110 and sprocket 112, which is mounted on a common shaft 114 with selector disc 116 and selector knob 26. Selector disc 116 is caused thereby to also rotate forcing lateral foot 120 of interlock arm 122 from detent recess 118. Arm 122, being directionally biased by spring 62 on pin 63, is thereby caused to pivot about pin 124 in order to place its opposite foot 126 into recess 128 of interlock disc 130. With disc 130 connected to operating handle 27 via shaft 132, rotation of operating handle 27 is thereby precluded. By then placing operating handle 36 paired with knob 34 to the "on" position, blend selector pawl 104 is displaced into a position between two bosses 105 on the blend selector wheel 106. Preventing rotation of wheel 106 also prevents movement of chain 110 such that neither sprocket 112, selector disc 116, or selector knob 26 can be rotated.

Interlock components operable when dispensing unleaded fuel include already described disc 116 having a dished recess 118. Interlock arm 122 is biased clockwise by spring 62 about pin 124 whereby its upper lateral detent 120 is adapted to be received in the recess 118. The lower foot 126 of arm 122 is received in recess 128 of interlock disc 130 secured on shaft 132 commonly supporting operating handle 27 paired with knob 26. The output end of lever 134 on shaft 132 is connected to a link lever 136 which operates a lever arm 138 secured via hub 140 on shaft 85 laterally removed and about 90 degrees displaced from lever arm 146. Displacement of arm 138 counterclockwise is effected by link 136 from the arm position shown solid to the arm position shown dashed in FIG. 5.

Responding to rotation imposed on shaft 85 is a hub 144 having a lever arm 146 supporting at its distal end an offset end 148 of an actuating rod 150. The rod extends slideably through clevis 152 and includes a collar 154 shown in FIG. 4 in its actuating position engaging against the clevis. Extending from the clevis is a lateral stub 156 connected to the distal end of a lever arm 158 supported from a hub 160 secured to shaft 102.

Figure 1:
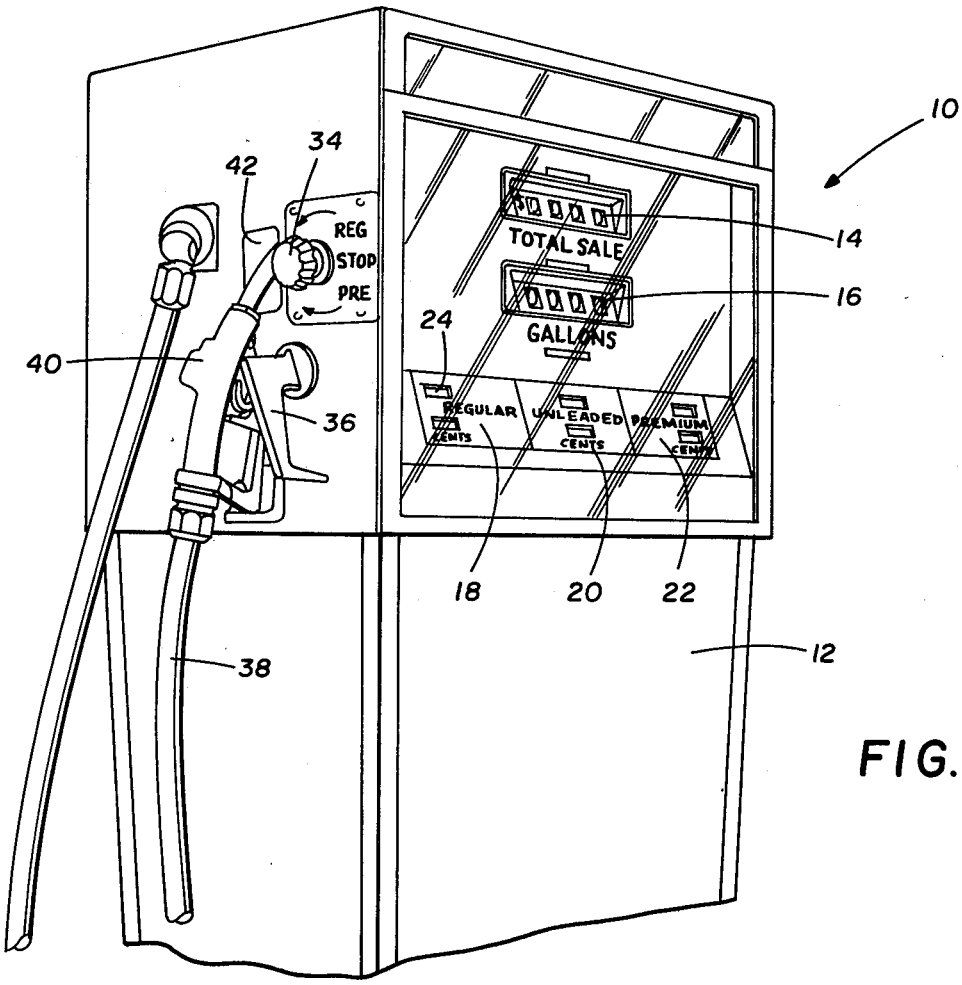
FIG. 1 is a left to front isometric view of a gasoline dispenser unit for optionally dispensing three separate products, including unleaded fuel and one of two or more grades of leaded fuel.
Figure 2:
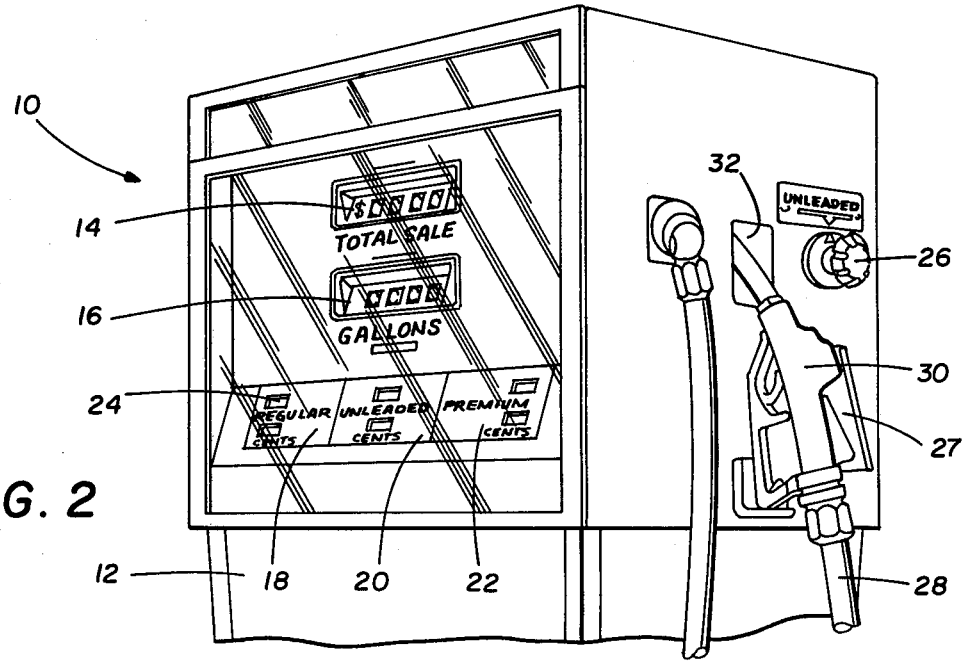
FIG. 2 is a fragmentary front to right isometric view of the dispenser of FIG. 1.
Figure 3:
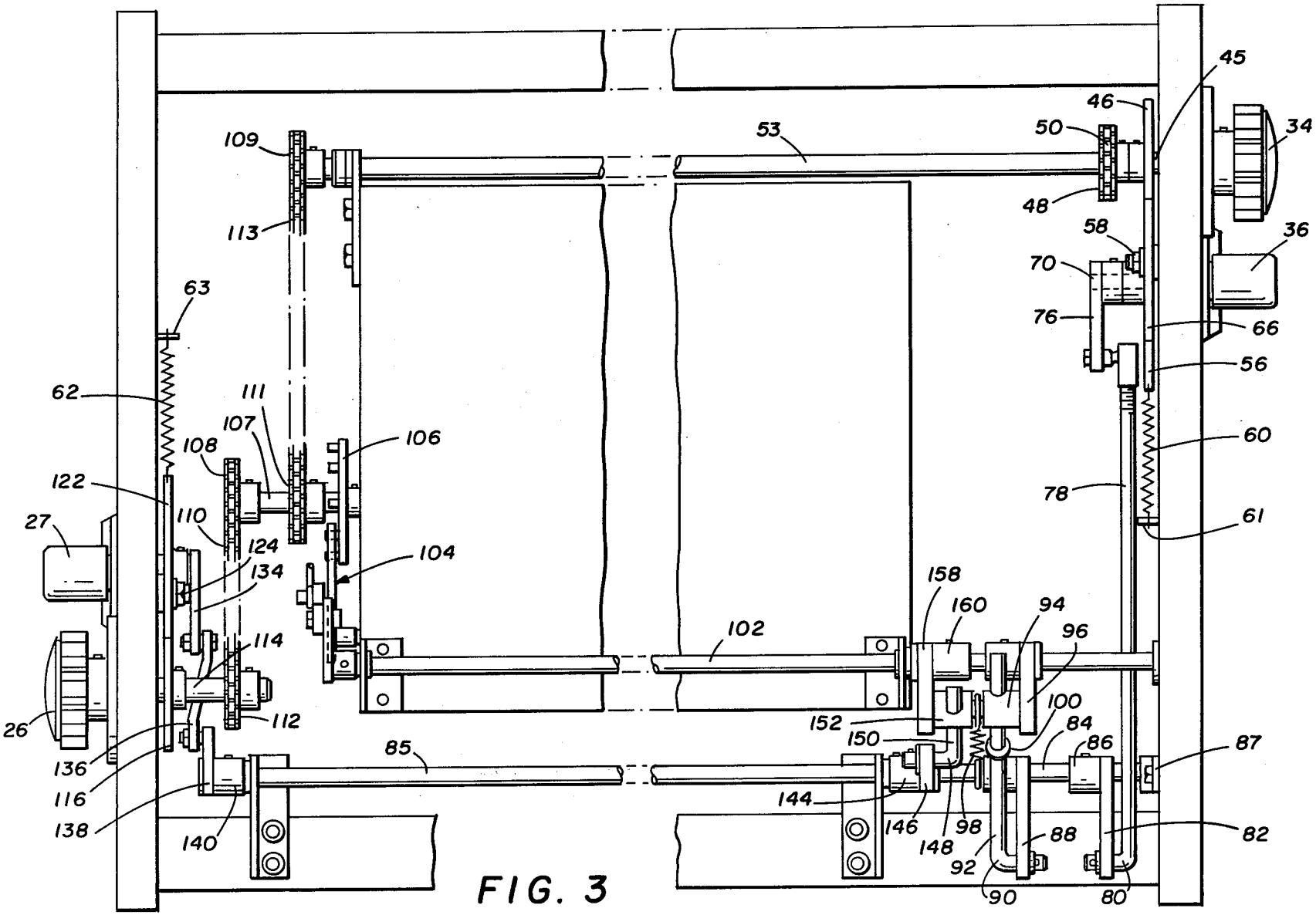
FIG. 3 is a plan view of the selector and interlock linkage for product selection and dispensing.
Figure 4:
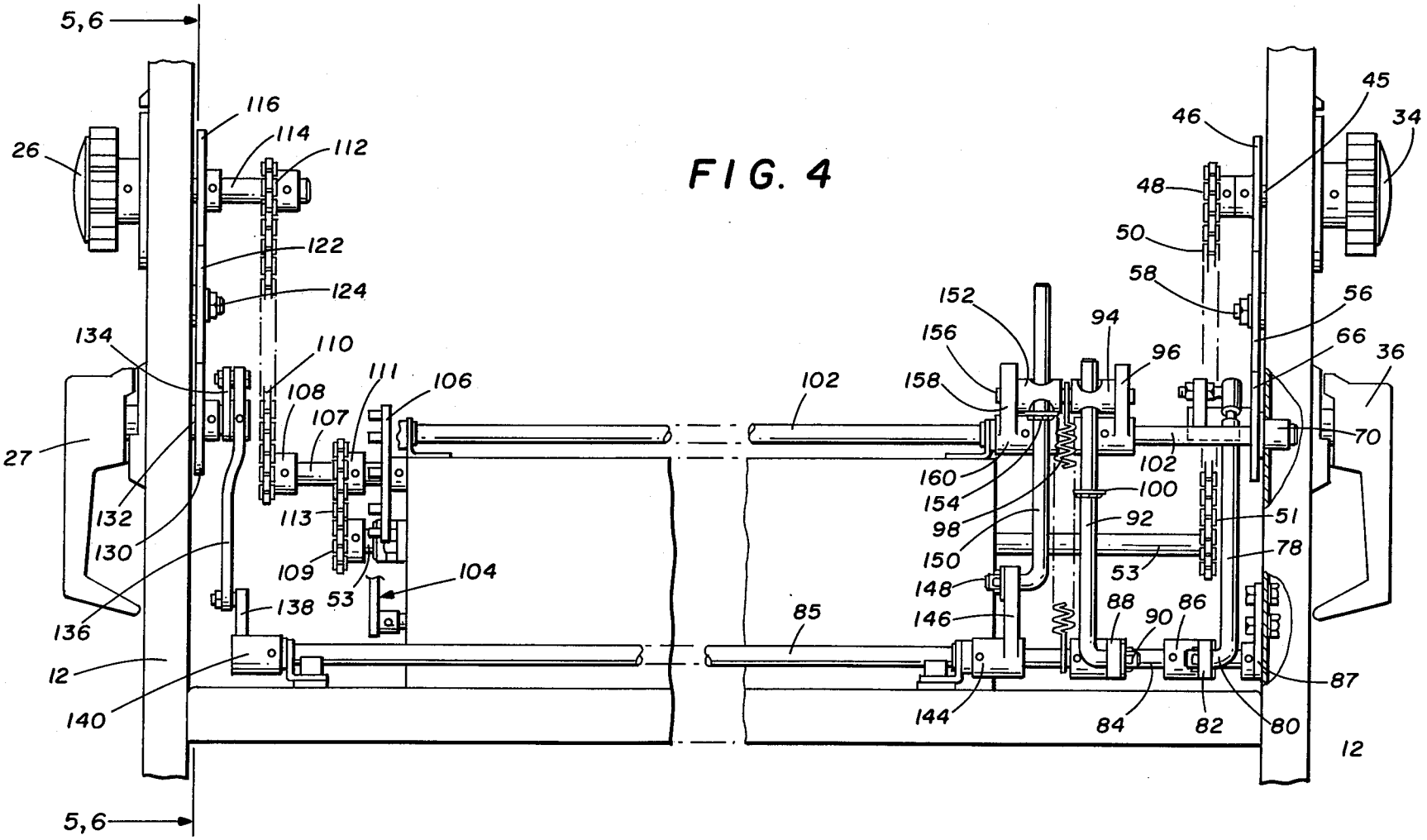
FIG. 4 is an elevation view of the linkage of FIG. 3.

When selecting to dispense unleaded fuel, selector knob 26 is first rotated until the arrow on the rotatable disc aligns with the stationary arrow on pump housing 12 (FIG. 2). Operating handle 27 can then be turned in a clockwise direction to "on". This in turn rotates lever 134 and via link 136, hub 140 and arm 138 are rotated in a counterclockwise direction causing shaft 85 to likewise be rotated. A lever comprised of hub 144 and an arm 146 to which rod end 148 is attached is thereby rotated, and movement effected thereby upwardly displaces collar 154 on rod 150 toward clevis 152. The clevis as described above will, when rotated by rod shoulder 154, rotate shaft 102 a like amount.

The interlock to prevent either leaded selector knob 34 or paired operating handle 36 from being activated or even rotated when dispensing unleaded fuel is effected in a manner analogous to that previously described. Briefly, this includes rotating unleaded selector knob 26 to its dispensing position supra, thereby placing selector disc 46 for leaded fuels at a point where knob end 54 of interlock arm 56 is ejected from disc recess 52. This enables opposite foot end 64 of arm 56 to enter detent recess 68 in the disc 66 connected to operating handle 36.

Rotation of shaft 102, in the course of the above and which in this instance is controlling an unleaded fuel delivery, readies the computer for zeroizing. Energizing the power source is accomplished by a separate switch (not shown) controlled by movement of foot 120 of interlock arm 122 that is interconnected with a switch arm (not shown). Unless the foot is contained in detent lobe 118 of the unleaded fuel selector disc 116, the power switch cannot be energized.

Whichever type or grade of fuel is selected by a customer operating either of selector knobs 26 or 34, the appropriate meter 162, 164 or 166 (FIGS. 7 and 8) will be actuated for unleaded, regular or premium, respectively. When either of the associated operating handles 27 or 36 is placed in their operative "on" position, the foregoing interlock is effected and circuits closed enabling the respective nozzle 30 or 40 to be triggered for operating the meters of the selected fuel in a customary manner. By means of a chain drive 168, meter 164 transmits its output through shaft 170 to a first input 186 of a computer 44 which is of a type commercially available. Similarly, chain drives 174 and 176 transmit outputs from their respective meters 162 and 166 to a clutch drive control 180 and one way clutch 182. The clutch control and clutch are of a commercially available type manufactured by the Zero Max Company of Minneapolis, Minn. and function to transmit either of the received inputs from the individual meters through shaft 184 to the second input 188 of computer 44.

In operation before dispensing can begin, an interlock must first be effected. This is achieved by the customer rotating one of selector knobs 26 or 34 in accordance with the desired type and grade of fuel to be purchased. If selecting a leaded fuel, knob 34 is rotated placing the detent end 54 of interlock arm 56 into recess 52 of disc 46 while enabling foot 64 to release disc 66 connected to paired operating handle 36. Rotating handle 36 operates link lever 78 to rotate lever arm 82 on shaft 84 whereby rod 92 effects rotation of shaft 102. Rotation of shaft 102 in turn causes pawl 140 to interlock with blend selector indexing wheel 106 connected via idler pulley 108 and chain 110 to shaft 114 supporting disc 116 and unleaded selector knob 26. The effected rotation of knob 26 places it in its non-dispensing relation as shown in FIG. 5 during which foot 120 of interlock arm 122 is ejected from recess 118, and foot 126 secures disc 132 against rotation.

Similarly as above, should unleaded fuel be selected, knob 26 can be appropriately set enabling disc 116 to be rotated until placing its recess 118 in position to receive the lateral end 120 of interlock arm 122. In the course of interfitting, arm 122 will pivot outwardly about pin 124 enabling opposite foot 126 to release disc 130. By then rotating handle 27, disc 130 is rotated counterclockwise from the position shown in FIG. 5 whereby link lever 136 produces counterclockwise rotation of lever arm 138 to the position shown dashed. The latter in turn rotates shaft 84 for pivotting lever arm 146 to move rod 150 upwardly until shaft 102 is rotated via displacement of lever arm 158. The connecting linkage and chain drive act to position knob 34 and disc 66 until foot 54 of interlock arm 56 is ejected from recess 52 and foot 64 is received in disc recess 68 thereby securing the leaded fuel systems against operation.

By the above description there is disclosed novel apparatus for customer selected dispensing of either unleaded or two or more grades of leaded gasoline from a common dispenser housing. Rather than using different dispensers for dispensing different qualities of gasoline such as leaded and unleaded and different grades of gasoline such as regular or premium, the invention hereof enables these different qualities and grades to be dispensed from a single unit thereby significantly reducing the cost of the dispensing equipment as compared to similar installations of the prior art. By means of a relatively simple but effective mechanism, three or more of these different products can be readily dispensed from a single dispenser unit in a relatively uncostly manner while preserving the separateness required to be maintained between leaded and unleaded fuel in dispensing operations.

Whereas the invention has been described in terms of one grade of unleaded gasoline and two or more grades of leaded gasoline, it is not intended that the invention be so limited. To the contrary, it is anticipated and indeed contemplated that with governmental regulations continuing to increasingly emphasize lower automotive pollutant emissions, demands for the currently available grades of leaded gasoline and possibly leaded gasoline itself could ultimately become commercially obsolete. The latter could therefore possibly result in different grades of unleaded gasoline with only one grade of leaded gasoline and for which the invention hereof would be equally suitable.

Since many changes could be made in the above construction and many apparently widely different embodiments of this invention could be made without departing from the scope thereof, it is intended that all matter contained in the drawings and specification shall be interpreted as illustrative and not in a limiting sense.

The embodiments of the invention in which an exclusive property or privilege is claimed are defined as follows:

1. A multiple product gasoline dispenser including in combination:

(a) a dispenser housing;

(b) a first dispenser system adapted to be connected to a source of unleaded gasoline from inward of said housing;

(c) a second dispenser system hydraulically isolated from said first dispenser system and adapted to be connected to at least one source of leaded gasoline from inward of said housing;

(d) selector means on said housing operable when predeterminably set in dispensing relation to enable actuating one or the other of said dispensing systems;

(e) first interlock means operable in conjunction with operating said selector means for enabling actuating said first dispenser system to prevent actuating said second dispensing system;

(f) second interlock means operable in conjunction with operating said selector means for enabling actuating said second dispenser system to prevent actuating said first dispenser system; and (g) a computer common to both of said dispenser systems for calculating dispensing data of each individual dispenser transaction effected by either of said dispenser systems.

2. A multiple product gasoline dispenser according to claim 1 in which one of said dispenser systems is adapted to be connected to multiple sources of gasoline of different grades and said selector means is also operable to enable selecting any of the available gasoline grades from said multiple source dispenser system.

3. A multiple product gasoline dispenser according to claims 1 or 2 in which selector means includes one selector unit operable for selecting to dispense unleaded gasoline in conjunction with said first dispenser system and another selector unit operable for selecting to dispense leaded gasoline in conjunction with said second dispenser system.

4. A multiple product gasoline dispenser according to claim 3 in which said selector units are interconnected whereby setting one in dispensing relation effects setting the other in non-dispensing relation.

5. A multiple product gasoline dispenser according to claim 4 in which said first or second interlock means are respectively operable to secure a selector unit set in its non-dispensing relation against resetting to its dispensing relation.

6. A multiple product gasoline dispenser according to claim 5 including operating handles on said housing each paired for use with one of said selector units, each of said operating handles being rotatable between "off"

and "on" positions when its said paired selector unit has been operably set in its dispensing relation.

7. A multiple product gasoline dispenser according to claim 6 in which said first or second interlock means is also operable to secure the operating handle paired with the secured selector unit against rotation from its "off" position.

* * * * *